United States Patent [19]

Ewald

[11] 4,383,476

[45] May 17, 1983

[54] APPARATUS FOR CONTROLLING A SINGLE ACTION OPERATING CYLINDER, ESPECIALLY OF A PRESS OPERATING CYLINDER

[75] Inventor: Roland Ewald, Lohr/Main, Fed. Rep. of Germany

[73] Assignee: G. L. Rexroth GmbH, Fed. Rep. of Germany

[21] Appl. No.: 201,300

[22] Filed: Oct. 27, 1980

[30] Foreign Application Priority Data

Oct. 29, 1979 [DE] Fed. Rep. of Germany ..... 2943642

[51] Int. Cl.[3] ..... F15B 11/08

[52] U.S. Cl. ..... 91/442; 137/107

[58] Field of Search ..... 91/442, 47; 137/102, 137/107

[56] References Cited

U.S. PATENT DOCUMENTS 3,958,495 5/1976 Bernhoft ..... 137/102 X 4,036,106 7/1977 Athy ..... 91/442 X 4,210,165 7/1980 Kitsugi ..... 137/102

*Primary Examiner*—Robert G. Nilson

*Attorney, Agent, or Firm*—Roylance, Abrams, Berdo & Farley

[57] ABSTRACT

An apparatus for controlling a single action piston and cylinder having means biasing the piston toward a retracted position within the cylinder and having a non-return valve openable toward the cylinder connecting the cylinder with a fluid pressure source comprises a control valve and a proportional valve. The control valve has an inlet in fluid communication with a supply tank, an outlet in fluid communication with a supply tank, a control port in fluid communication with the fluid pressure source, and a control element movable between open and closed positions for controlling flow of fluid pressure from the inlet to the outlet. The control element is spring biased toward the open position and forced toward the closed position by pressure entering through the control port. The proportional valve regulates the pressure entering through the control port.

4 Claims, 3 Drawing Figures

APPARATUS FOR CONTROLLING A SINGLE ACTION OPERATING CYLINDER, ESPECIALLY OF A PRESS OPERATING CYLINDER

The invention relates to an apparatus for controlling operation of a single action piston and cylinder having means for biasing the piston toward a retracted position of the type used in a press.

BACKGROUND OF THE INVENTION

In a known apparatus for controlling a single action action piston and cylinder has an electric control device, separate control elements are required for the control of the speed of movement between the piston and the cylinder and of the press pressure in the pressure chamber of the operating cylinder.

BRIEF DESCRIPTION OF THE INVENTION

An object of the present invention is to provide an apparatus for completely controlling operation of a single action piston and cylinder with a single proportional valve.

Other objects, advantages and salient features of the present invention will become apparent from the following detailed description of a preferred embodiment of the invention.

Briefly described, the invention includes an apparatus for controlling a single action piston and cylinder having means biasing the piston toward a retracted position within the cylinder and having a first non-return valve openable toward the cylinder connecting the cylinder with a fluid pressure source. The apparatus comprises a control valve and a proportional valve. The control valve has an inlet in fluid communication with the cylinder, an outlet in fluid communication with a supply tank, a control port in fluid communication with the fluid pressure source, and a control element movable between open and closed positions for controlling flow of fluid pressure from the inlet to the outlet. The control element is spring biased toward the open position and forced toward the closed position by pressure entering through the control port. The proportional valve regulates the pressure entering through the control port. The electrically or mechanically adjustable proportional valve may be controlled by an electric control device and/or by a pressure regulator. The pressure regulator monitors the maximal pressure in the pressure chamber of the piston and cylinder and the control device determines the position of the piston and cylinder and the speed in case of the mutual movement. The control device provides accident in connection with an operating cylinder, especially a press operating cylinder.

BRIEF DESCRIPTION OF THE DRAWINGS

In order that the manner in which the foregoing and other objects are attained in accordance with the invention can be understood in detail, a particularly advantageous embodiment thereof will be described with reference to the accompanying drawings, which form a part of this specification, and wherein.

DETAILED DESCRIPTION OF THE PREFERRED EMBODIMENT OF THE INVENTION

Figure 1:
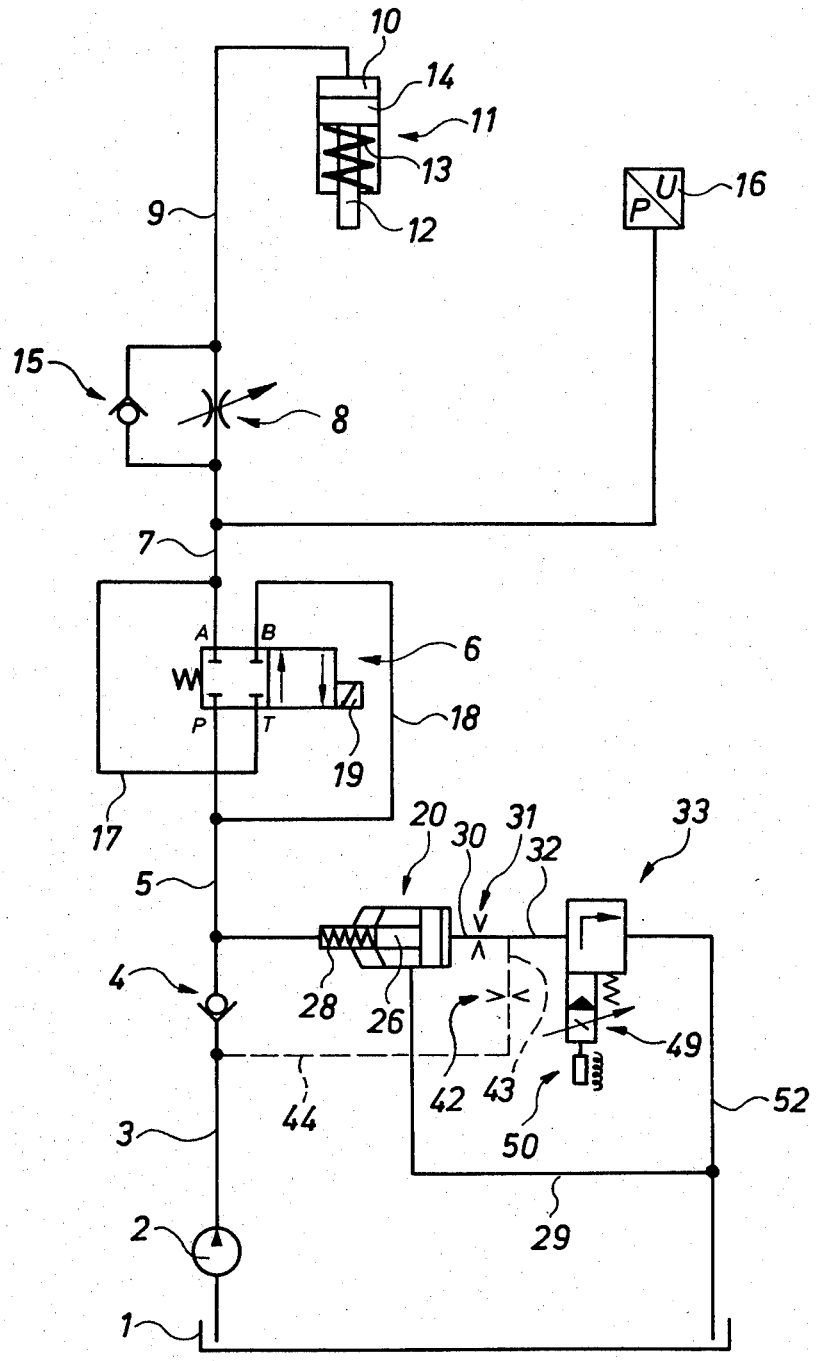
FIG. 1 is a schematic circuit diagram of an apparatus for controlling a single action piston and cylinder according to the present invention.

A pump 2 pressurizes fluid from a supply tank 1 connected by way of a line 3 with a non-return valve 4 closing toward the pump. A line 5 leads to the pump connection P of a pilot valve 6 comprising a 4 port, two-way valve with only on and off positions. A line 7 is connected with the consumer connection A of this pilot valve, which line leads via an adjustable restrictor 8 and a line 9 to a pressure chamber 10 of an operating cylinder 11, the piston rod 12 of which projects downwards. A spring 13 biases the piston 14 toward its upper position. The restrictor 8 is by-passed by a non-return valve 15 closing in the direction toward the pressure chamber 10. A pressure generator 16 is connected to the line 7 and produces electric signals corresponding to the pressure measured by it.

The pilot valve 6 has its tank connection T connected via a line 17 with the line 7 connected to the connection A. A line 18 connects the connection B with the line 5 connected with the pump connection P. In the position of the control slide of the pilot valve 6 as shown, all connections are blocked. In the other position of the control slide, the connections P and A as well as T and B are always interconnected. The control slide of the pilot valve 6 is operable by means of an electromagnet 19. Lines 17, 18 provide a dual flow through valve 6 to minimize flow resistance therethrough and permit use of a smaller valve.

Figure 2:
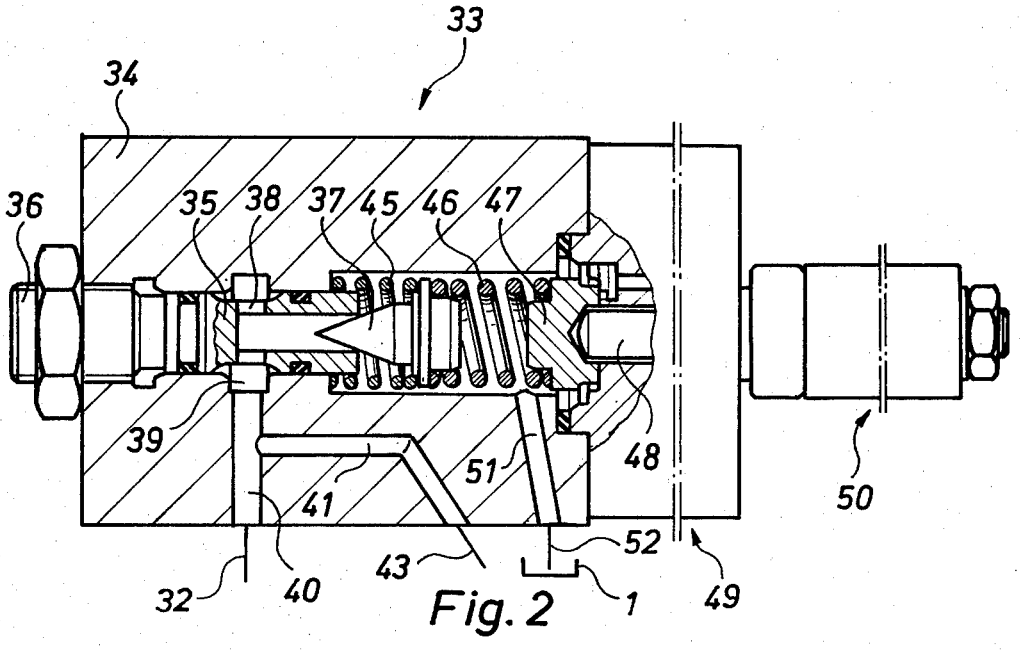
FIG. 2 is an elevational view in cross section of a proportional control valve of the apparatus of FIG. 1.
Figure 3:
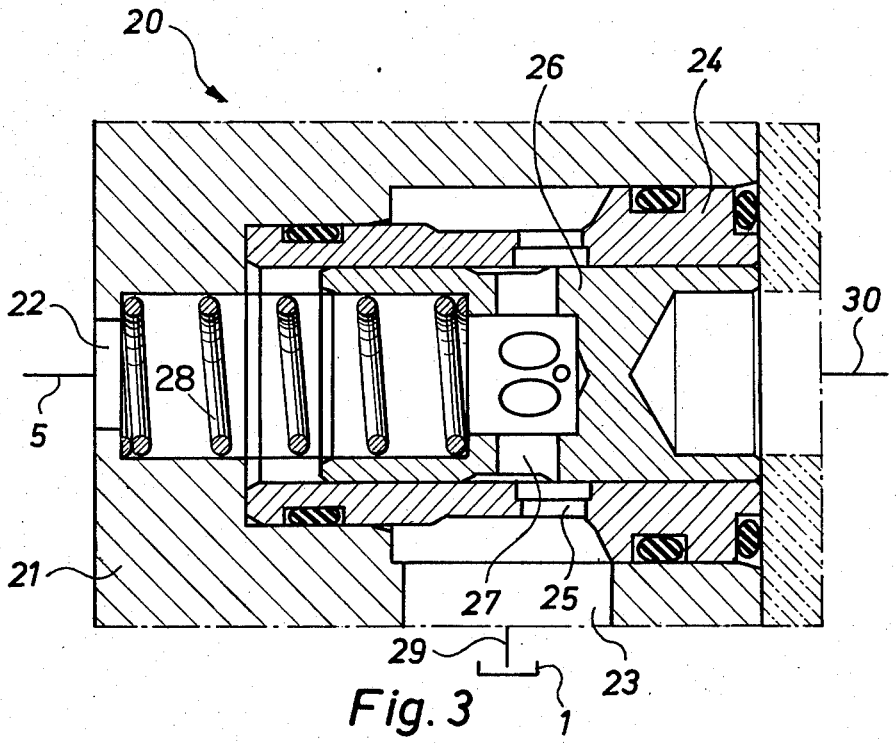
FIG. 3 is an elevational view in cross section of a control valve of the apparatus of FIG. 1.

A control valve 20, which is shown in FIG. 3, is connected to line 5. The control valve has a housing 21 with an inlet 22 and an outlet 23. The inlet 22 runs coaxially to the stepped longitudinal bore in the housing 21, whereas the outlet 23 is disposed at a right angle thereto. A bush 24 is inserted into the axial bore of the housing 21, at one front side of which is the inlet 22 and which, in the area of the outlet 23, has a plurality of circumferentially spaced outlet bores 25. In the bush 24, a control slide 26 has been mounted for axial movement. In cross section, slide 26 is developed in the form of an H and has, in the area of its cross wall, a plurality of circumferentially spaced radially disposed control bores 27. The control slide 26 is surrounded in the area of the control bores 27 by an annular groove displaced relative thereto. This annular groove in the opened position of the control slide 26 is connected with outlet bores 25. Between the housing 21 and the control slide 26, a spring 28 has been fixed, which biases the control slide toward its open position. The outlet 23 is connected via a line 29 with the supply container 1. On the side facing away from the spring 28, the control slide 26 is connected with the line 30 including a restrictor 31 is connected by line 32 with a pressure proportional valve 33, which is shown in FIG. 2. The line 30 is connected to a lid part connected with the housing 21, on which the parts 24 and 26 are supported in the position shown in FIG. 3.

The proportional valve 33 has a housing 34 in the longitudinal bore of which a casing-shaped valve body 35 has been accommodated which on its closed side is supported by a screw 36 threaded into the housing 34 and on the open side of which forms a valve seat for a cone-shaped valve element 37. The valve body 35 in the area of its bottom has radial bores 38 which lead into an annular channel 39 provided in the housing 34. The annular channel 39 is connected with the radial bore 40 to which the line 32 is connected.

A channel 41 which is connected to a control line 43 leads into the radial bore 40. The restrictors 31 and 42 shown in FIG. 1, may be disposed inside of the proportional valve 33.

The valve element 37 is located between two valve springs 45 and 46. The valve spring 45 on its side facing away from the valve element 37 is supported by the housing 34, whereas the valve spring 46 on its side facing away from the valve element 37 is supported by an axially movable spring plate 47 which is seated on a pestle 48 of an electromagnet 49, which is connected with a displacement pickup 50. In FIG. 2, the pestle 48 is shown in its rest position. Spring plate 47 is moved to the left, as seen in the drawing, for a distance equalling approximately half the spacing between the spring plate 47 and the valve element 37 illustrated in FIG. 2. The space accommodating the valve spring 46 is connected with the line 52 via a bore 51, which line is connected to the supply container 1. Valve springs 45,46 permit the opening pressure for valve 33 to be set at zero. Spring 45 prevents valve element 37 from twisting out of alignment with valve body 35 and maintains the coupling of valve element 37, spring 46, spring plate 47 and pestle 48.

The electromagnet 49, displacement pickup 50, pressure regulator 16 and electromagnet 19 are connected to an electronic control device (not shown) of generally conventional construction for permitting centralized control of the apparatus. The pressure generator 16 responds to the pressure in line 7 and to the maximum pressure in the pressure chamber 10 of the operating cylinder 11. The movement of the piston rod 12 of the operating cylinder 11 is controlable with respect to direction and speed with the help of the control device. The control device also has monitoring arrangements which satisfy accident prevention regulations for press controls. Between the electric signal of the pressure generator 16 and the electric signal at the displacement pickup 50 there is a proportional connection.

The pump 2, when the control slide of the pilot valve 6 is in the blocking position illustrated in FIG. 1, conveyes pressure agent by way of the control valve 20 into the supply container 1. Whenever the control slide of the pilot valve 6 assumes its other control position and whenever a desired pressure is preselected at the proportional valve 33 by activating electromagnet 49, moving pestle 48 and spring plate 47 to the left (as illustrated in FIG. 2) to tension spring 46 against valve element 37 at a predetermined force, then the pump 2 is connected with the pressure chamber 10 of the operating cylinder 11, whereby the outgoing speed of the piston rod 12 is determined by the adjustable restrictor 8 and the preselected pressure on the proportional valve 33. The piston rod 12 moves out as soon as the force exerted by the pressure of the pressure agent in the pressure chamber 10 and the weight to be moved are greater than the force of the spring 13. As long as the pressure preselected on the proportional valve 33 in line 5 is not exceeded, the control valve 20 and the proportional valve 33 remain closed. If, however, the predetermined pressure is exceeded, then the proportional valve 33 is opened correspondingly and pressure agent can flow into line 52, whereby pressure is relieved on the side of the control slide 26 of the control valve 20, facing away from the spring 28, so that the control slide 26 is opened correspondingly. The restrictor 42 in this case is adjusted such that only a slight flow of pressure agent may be brought up by way of the control line 44. Restrictors 31,42 dampen the effect of pressure changes. Whenever the force exerted by the pressure of the pressure agent in the pressure chamber 10 and the weight that is to be moved are smaller than the force of the spring 13, then the piston rod 12 moves in. Whenever the mutually aligned forces however are equally great, then the piston 14 remains stationary.

The force exerted by the spring 46 on the valve element 37 is determined by the position of the spring plate 47 in the proportional valve 33, as a result of which the pressure in line 5 is also determined in the case of which the control slide 26 is opened. This control slide 26 may open so far that the pressure chamber 10 may be emptied quickly and without pressure.

Whenever the control valve 20 and/or the proportional valve 33 do not operate correctly or whenever there is a breakdown on the displacement pickup 50 or on the pressure generator 16, for example, if an improper pressure differential exists between the pressure measured by the pressure generator 16 and the pressure predetermined by the position of the pestle 48 in the proportional valve 33, then the electromagnet 19 of the pilot valve 6 as well as the electromagnet 49 of the proportional valve 49 will be deactivated by the control device. Then, the control slide of the pilot valve 6 assumes its blocking position shown in FIG. 1, and the pump is connected with the supply container 1 by opening of the control valve 20, induced by the opening of the proportional valve 33, that is to say, it is switched to pressureless circulation. Whenever one of the valves 20 or 33 does not switch, then it will be guaranteed that the piston rod 12 of the operating cylinder 11 cannot move out.

The speed of the movement of the piston rod 12 as well as the maximal pressure in the pressure chamber 10 may be preadjusted continuously in the control device. The control device also makes possible the acceleration of the piston rod 12 and to adapt its braking to the pertinent requirements. By synchronizing the compression spring in the non-return valve 4 and the compression spring 28 in the control valve 20, the control slide 26 of the control valve 20 quickly assumes a regulating position, so that no additional control pump will be required.

Thus, the movement of piston rod is controlled by the control device by controlling the position of pestle 48. The positioning of pestle 48 controls the operation of control valve 20, and thereby, the pressure supplied to pressure chamber 10 by pump 2 without varying adjustable restrictor 8. Additionally, this movement can be separately controlled by adjusting adjustable restrictor 8.

In the case of an operating cylinder moving out upwards, the energy storage may be a weight that is to be lifted.

I claim:

1. An apparatus for controlling a single action piston and cylinder having means biasing the piston toward a retracted position within the cylinder and having a first non-return valve openable toward the cylinder connecting the cylinder with a fluid pressure source, comprising a control valve having an inlet in fluid communication with the cylinder, an outlet in fluid communication with a supply tank and a control port in fluid communication with the fluid pressure source, said control valve including a control element movable between open and closed positions for controlling flow of fluid pressure from said inlet to said outlet, said control element being spring biased toward said open position and forced toward said closed position by pressure entering through said control port; and a proportional valve regulating the pressure entering through said port, said proportional valve including a valve element in fluid communication with the fluid pressure source through a first conduit having a first restrictor therein and being in fluid communication with said control port of said control valve through a second conduit having a second restrictor therein.

2. An apparatus for controlling a single action piston and cylinder having means biasing the piston toward a retracted position within the cylinder and having a first non-return valve openable toward the cylinder connecting the cylinder with a fluid pressure source, comprising a control valve having an inlet in fluid communication with the cylinder, an outlet in fluid communication with a supply tank and a control port in fluid communication with the fluid pressure source, said control valve including a control element movable between open and closed positions for controlling flow of fluid pressure from said inlet to said outlet, said control element being spring biased toward said open position and forced toward said closed position by pressure entering through said control port;

a proportional valve regulating the pressure entering through said central port;

first conduit means for connecting said control valve and the non-return valve in fluid communication with the piston and cylinder, said conduit means including an adjustable restrictor therein; and a second non-return valve closing toward the piston and cylinder coupled by bypass conduits to said conduit means upstream and downstream of said adjustable restrictor;

whereby fluid flowing from the fluid pressure source to the piston and cylinder passes through said adjustable restrictor, and fluid flowing from the piston and cylinder to the supply tank bypasses said adjustable restrictor by flowing through said bypass conduits and said second non-return valve.

3. An apparatus according to claim 2, wherein a controllable pilot valve controls fluid flow through said first conduit means and is located upstream of said adjustable restrictor and downstream of the first non-return valve and said control valve.

4. An apparatus for controlling a single action piston and cylinder having means biasing the piston toward a retracted position within the cylinder and having a first non-return valve openable toward the cylinder connecting the cylinder with a fluid pressure source, comprising a control valve having an inlet in fluid communication with the cylinder, an outlet in fluid communication with a supply tank and a control port in fluid communication with the fluid pressure source, said control valve including a control element movable between open and closed positions for controlling flow of fluid pressure from said inlet to said outlet, said control element being spring biased toward said open position and forced toward said closed position by pressure entering through said control port;

a proportional valve regulating the pressure entering through said control port, said proportional valve including a valve element in fluid communication with the fluid pressure source through a first conduit having a first restrictor therein and being in fluid communication with said control port of said control valve through a second conduit; and a third conduit connecting said control valve and the non-return valve in fluid communication with the piston and cylinder, and including a restrictor therein.

* * * * *